US008164556B2

(12) United States Patent
Song et al.

(10) Patent No.: US 8,164,556 B2
(45) Date of Patent: Apr. 24, 2012

(54) LIQUID CRYSTAL DISPLAY AND DRIVING METHOD THEREOF

(75) Inventors: Hong Sung Song, Gyeongsangbuk-do (KR); Woong Ki Min, Daegu (KR); Su Hyuk Jang, Daegu (KR)

(73) Assignee: LG Display Co., Ltd., Seoul (KR)

( * ) Notice: Subject to any disclaimer, the term of this patent is extended or adjusted under 35 U.S.C. 154(b) by 710 days.

(21) Appl. No.: 12/003,746

(22) Filed: Dec. 31, 2007

(65) Prior Publication Data

US 2008/0316161 A1 Dec. 25, 2008

(30) Foreign Application Priority Data

Jun. 25, 2007 (KR) ..... 10-2007-0062238

(51) Int. Cl.
*G09G 3/36* (2006.01)

(52) U.S. Cl. ..... 345/95; 345/87; 345/94; 345/96

(58) Field of Classification Search ..... 345/87–101, 345/110, 204, 205, 206, 208, 210–214
See application file for complete search history.

(56) References Cited

U.S. PATENT DOCUMENTS

| | | | | |
|---|---|---|---|---|
| 5,587,722 | A * | 12/1996 | Suzuki et al. | 345/94 |
| 6,091,387 | A | 7/2000 | Ueno et al. | 345/89 |
| 6,219,019 | B1 | 4/2001 | Hasegawa et al. | 345/96 |
| 6,903,715 | B2 | 6/2005 | Song | 345/94 |
| 6,909,415 | B2 | 6/2005 | Kumagawa et al. | 345/92 |

(Continued)

FOREIGN PATENT DOCUMENTS

| | | |
|---|---|---|
| CN | 1692398 A | 11/2005 |
| JP | 10-111670 | 4/1998 |
| JP | H10-133176 | 5/1998 |
| JP | H11-281957 | 10/1999 |

(Continued)

OTHER PUBLICATIONS

Japanese Office Action dated Jun. 20, 2011 and English translation.

*Primary Examiner* — Amare Mengistu
*Assistant Examiner* — Dmitriy Bolotin
(74) *Attorney, Agent, or Firm* — Morgan, Lewis & Bockius LLP

(57) ABSTRACT

A liquid crystal display includes a liquid crystal display panel including a plurality of data lines, a plurality of gate lines crossing the plurality of data lines, and a plurality of liquid crystal cells defined as a first and second liquid crystal cell groups, a data driving circuit to supply a data voltage to the data lines in response to a polarity control signal, a gate driving circuit to supply a scanning pulse that swings between a gate high voltage and a gate low voltage to the gate lines, a first logic circuit to generate the polarity control signal differently for each frame period to maintain a polarity of the data voltage charged in the first liquid crystal cell group, and to invert one time a polarity of the data voltage charged in the second liquid crystal cell group for two frame periods, and a second logic circuit to control the gate driving circuit to decrease the gate high voltage of the scanning pulse to a modulated voltage between the gate high voltage and the gate low voltage for a predetermined modulation time.

10 Claims, 17 Drawing Sheets

U.S. PATENT DOCUMENTS

| | | | | |
|---|---|---|---|---|
| 7,002,542 | B2 * | 2/2006 | Lee | 345/94 |
| 7,015,904 | B2 * | 3/2006 | Kim | 345/212 |
| 7,106,291 | B2 * | 9/2006 | Yoon | 345/98 |
| 7,304,626 | B2 * | 12/2007 | Yanagi et al. | 345/94 |
| 7,460,114 | B2 * | 12/2008 | Mizumaki | 345/204 |
| 7,586,477 | B2 * | 9/2009 | Lee | 345/98 |
| 7,696,969 | B2 * | 4/2010 | Yanagi et al. | 345/94 |
| 7,764,257 | B2 * | 7/2010 | Park | 345/94 |
| 8,035,597 | B2 * | 10/2011 | Yanagi et al. | 345/94 |
| 2001/0033266 | A1 * | 10/2001 | Lee | 345/94 |
| 2005/0206596 | A1 | 9/2005 | Chen et al. | 345/87 |
| 2005/0248550 | A1 | 11/2005 | Kobayashi et al. | 345/205 |

FOREIGN PATENT DOCUMENTS

| | | |
|---|---|---|
| JP | 2002-072250 | 3/2002 |
| JP | 2002-196731 | 7/2002 |
| JP | 2003-029726 | 1/2003 |
| JP | 2004-212426 | 7/2004 |
| JP | 2005-266803 | 9/2005 |
| KR | 10-1998-0024357 | 10/1998 |

* cited by examiner

DC IMAGE STICKING

LIQUID CRYSTAL DISPLAY AND DRIVING METHOD THEREOF

This application claims the benefit of the Korean Patent Application No. P2007-0062238 filed on Jun. 25, 2007, which is hereby incorporated by reference.

BACKGROUND OF THE INVENTION

1. Field of the Invention

The present invention relates to a liquid crystal display, and more particularly to a liquid crystal display and a driving method thereof that is adapted to improve display quality by preventing flickers and DC image sticking.

2. Discussion of the Related Art

A liquid crystal display controls the light transmittance of liquid crystal cells in accordance with video signals, thereby displaying a picture. An active matrix type liquid crystal display actively controls data by switching data voltages supplied to liquid crystal cells using thin film transistors ("TFTs") that are formed at each liquid crystal cell Clc, as shown in FIG. 1, thereby increasing the display quality of motion pictures. As shown in FIG. 1, reference label "Cst" represents a storage capacitor for keeping data voltages charged in the liquid crystal cell "Clc," "DL" represents a data line to which the data voltages are supplied, and "GL" represents a gate line to which scan voltages are supplied.

The liquid crystal display is driven by an inversion method where polarities are inverted between adjacent liquid crystal cells and by a unit of a frame period in order to reduce the deterioration of liquid crystals and to decrease DC offset components. If any one polarity out of two polarities of the data voltage is dominantly supplied for a long time, a residual image is generated. Such a residual image is called "DC image sticking" because the residual image is generated by a voltage of the same polarity repeatedly charged in the liquid crystal cell. One such example occurs when data voltages of an interlace method are supplied to the liquid crystal display. In the interlace method, data voltages to be displayed on the liquid crystal cells (hereinafter, referred to as "interlace data") exist only in odd-numbered horizontal lines during odd-numbered frame periods and only in even-numbered horizontal line in even-numbered frame periods.

FIG. 2 illustrates a waveform diagram representing an example of a data voltage of an interlace method supplied to a liquid crystal cell Clc. For purposes of example, the data voltage of FIG. 2 is supplied is any one of the liquid crystal cells disposed on an odd-numbered horizontal line. As shown in FIG. 2, the liquid crystal cell Clc is supplied only with positive voltages for an odd-numbered frame period and only with negative voltages for an even-numbered frame period. In the interlace method, high positive data voltages are supplied only for the odd-numbered frame periods to the liquid crystal cells Clc disposed on the odd-numbered horizontal lines. Thus the positive data voltage, like the waveform shown within the box in FIG. 2, becomes more dominant than the negative data voltage over four frame periods, thereby causing DC image sticking to occur.

FIG. 3 illustrates an image showing an experimental result of DC image sticking generated due to interlace data. If an original image, like the image shown on the left in FIG. 3, is supplied to a liquid crystal display panel using the interlace method for a fixed time, the data voltage of which the polarity is changed by the unit of a frame period has its amplitude changed in the odd-numbered frame and in the even-numbered frame. As a result, if a data voltage of an intermediate gray level, e.g., the gray level of 127, is supplied to all of the liquid crystal cells Clc of the liquid crystal display panel after the original image (i.e., the left image), DC image sticking occurs showing a dim pattern of the original image, like the image shown on the right in FIG. 3.

As another example of DC image sticking, if an unchanging picture is moved or scrolled at a fixed speed, DC image sticking may be generated because the voltage of the same polarity is repeatedly accumulated in the liquid crystal cell Clc depending on the scroll speed (or moving speed) and the size of the scrolling picture (i.e., moving picture). Such an example is shown in FIG. 4. FIG. 4 illustrates an image showing an experimental result of DC image sticking that occurs when moving an oblique line or character pattern at a fixed speed.

In the liquid crystal display, the display quality of motion pictures is not only reduced by DC image sticking, but also by a flicker phenomenon generated by a brightness difference that is visually perceived. Accordingly, in order to increase the display quality of the liquid crystal display, the flicker phenomenon the DC image sticking need to be prevented.

SUMMARY OF THE INVENTION

Accordingly, the present invention is directed to a liquid crystal display and a driving method thereof that substantially obviates one or more problems due to limitations and disadvantages of the related art.

An object of the present invention is to provide a liquid crystal display and a driving method thereof that is adapted to improve display quality by preventing flickers and DC image sticking.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display includes a liquid crystal display panel including a plurality of data lines, a plurality of gate lines crossing the plurality of data lines, and a plurality of liquid crystal cells defined as a first and second liquid crystal cell groups, a data driving circuit to supply a data voltage to the data lines in response to a polarity control signal, a gate driving circuit to supply a scanning pulse that swings between a gate high voltage and a gate low voltage to the gate lines, a first logic circuit to generate the polarity control signal differently for each frame period to maintain a polarity of the data voltage charged in the first liquid crystal cell group, and to invert one time a polarity of the data voltage charged in the second liquid crystal cell group for two frame periods, and a second logic circuit to control the gate driving circuit to decrease the gate high voltage of the scanning pulse to a modulated voltage between the gate high voltage and the gate low voltage for a predetermined modulation time.

In another aspect, a method of driving a liquid crystal display including a liquid crystal display panel that has a plurality of data lines, a plurality of gate lines crossing the plurality of data lines, and plurality of liquid crystal cells defined as a first and second liquid crystal cell groups, includes the steps of supplying a data voltage to the data lines in response to a polarity control signal, supplying a scanning pulse, which is swung between a gate high voltage and a gate low voltage, to the gate lines, generating the polarity control signal differently for each frame period to maintain a polarity of the data voltage in the first liquid crystal cell group, and to invert one time a polarity of the data voltage charged in the second liquid crystal cell group for two frame periods, and decreasing the gate high voltage of the scanning pulse to a modulated voltage between the gate high voltage and the gate low voltage for a predetermined modulation time.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to the embodiments of the present invention, examples of which are illustrated in the accompanying drawings.

Figure 1:
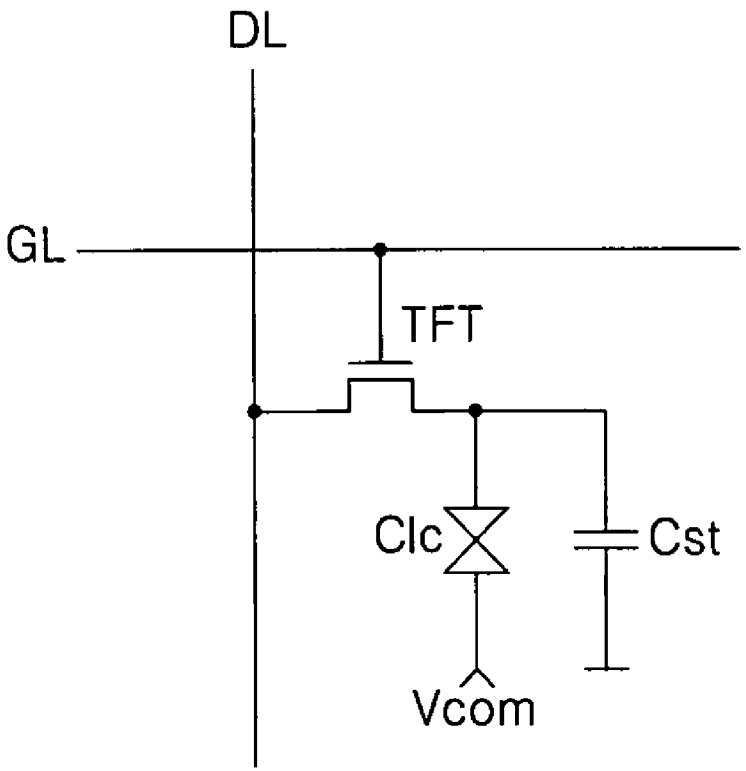
FIG. 1 RELATED ART
FIG. 1 is a circuit diagram illustrating a liquid crystal cell of a liquid crystal display.
Figure 2:
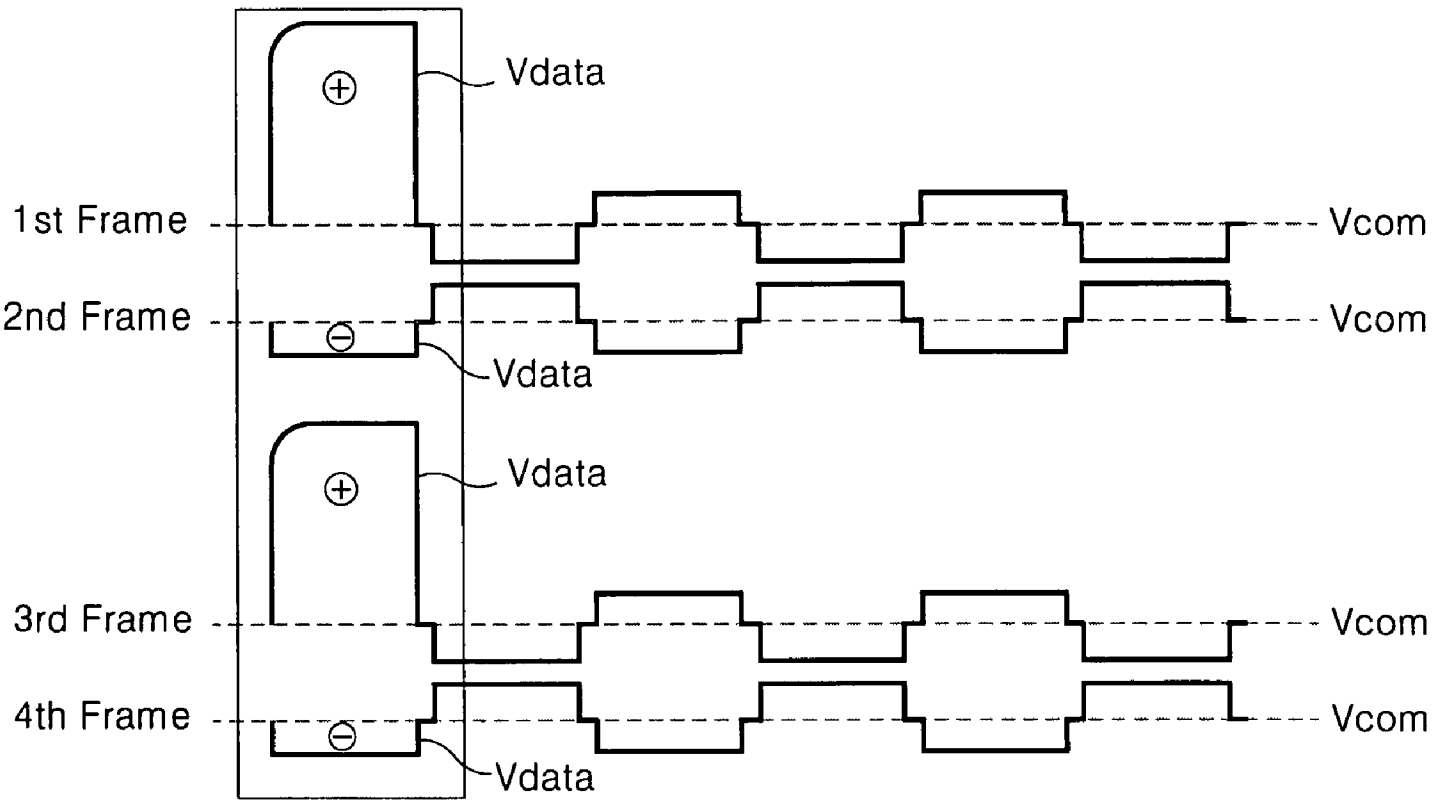
FIG. 2 RELATED ART
FIG. 2 is a waveform diagram illustrating an example of interlace data.
Figure 3:
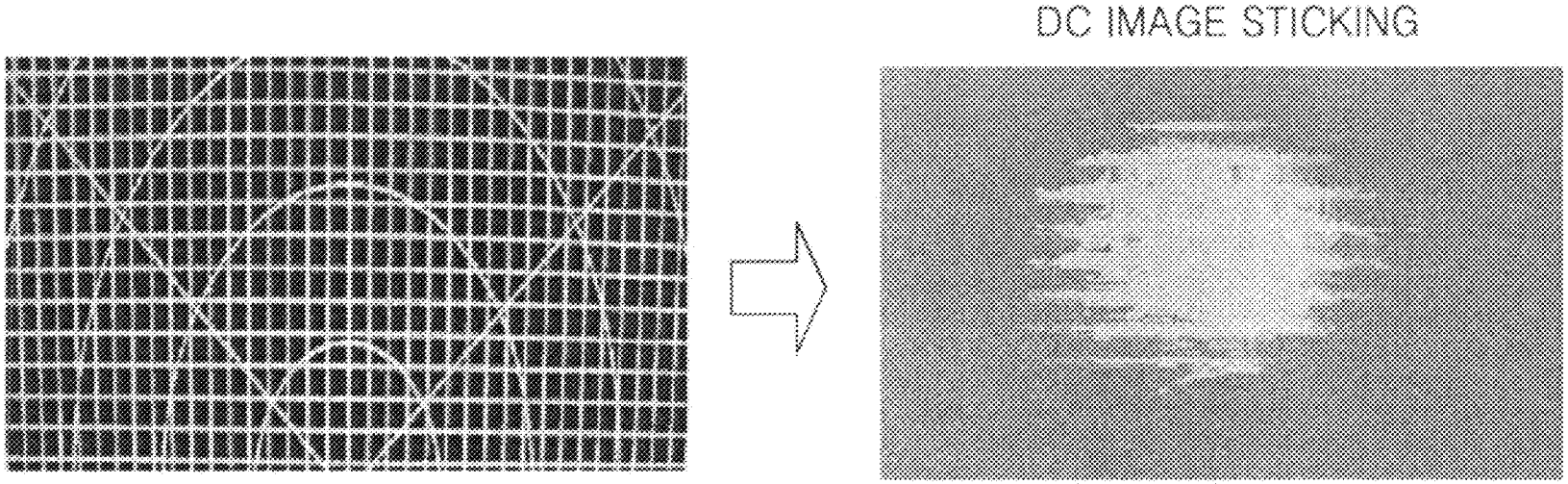
FIG. 3 RELATED ART
FIG. 3 is an experimental result screen illustrating DC image sticking caused by the interlace data.
Figure 4:
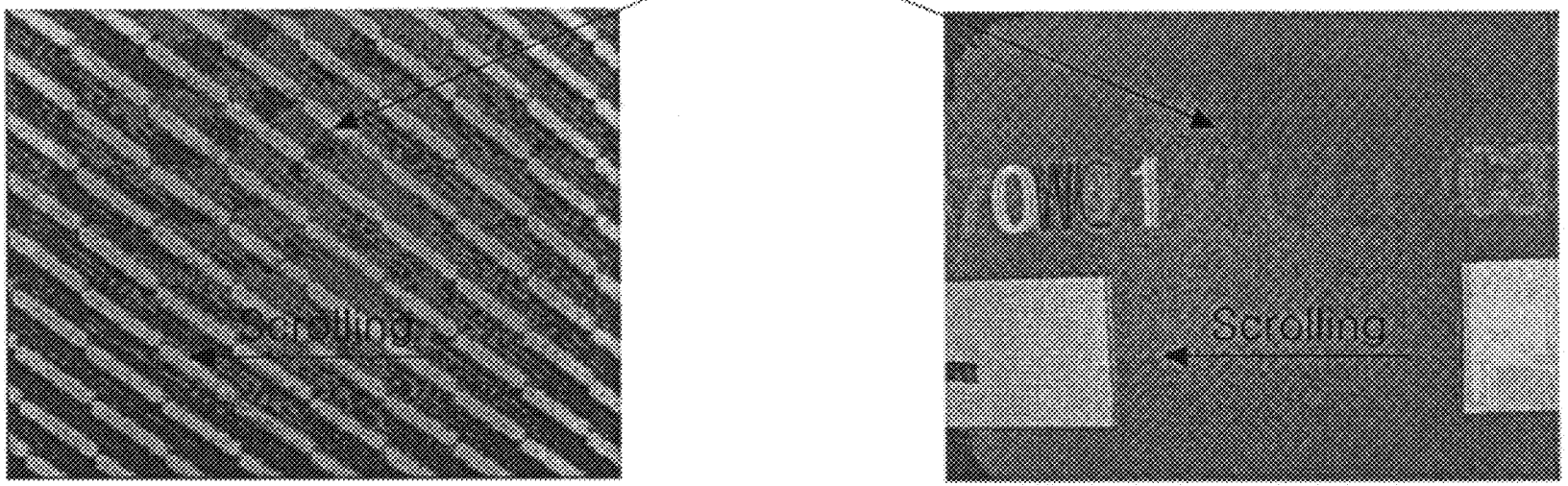
FIG. 4 RELATED ART
FIG. 4 is an experimental result screen illlusrating DC image sticking caused by scroll data.
Figure 5:
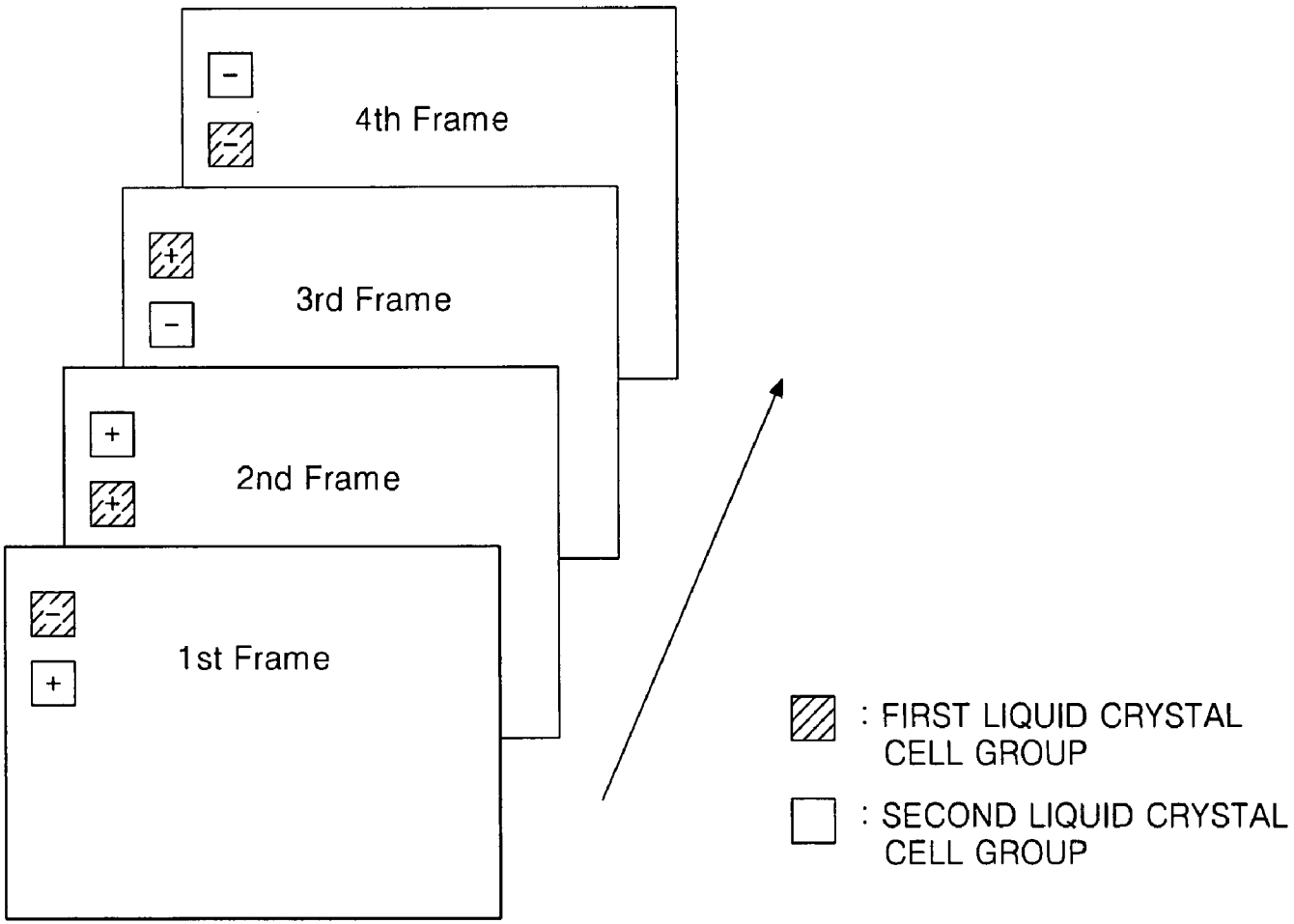
FIG. 5 is a diagram illustrating an exemplary method of driving a liquid crystal display according to a first embodiment of the present invention.

FIG. 5 illustrates a method of driving a liquid crystal display according to an exemplary embodiment of the present invention. As shown in FIG. 5, the method of driving a liquid crystal display according to the exemplary embodiment of the present invention includes driving a first liquid crystal cell group with a drive frequency that is different from a drive frequency of a second liquid crystal cell group for two frame periods. For purposes of example, the first liquid crystal cell group is adjacent to the second liquid crystal cell group.

Polarities of data voltages, which are charged in liquid crystal cells of the first liquid crystal cell group and liquid crystal cells of the second liquid crystal cell group, are inverted for each two frame periods. The method of driving the liquid crystal display according to the exemplary embodiment of the present invention controls a polarity inversion cycle of the first liquid crystal cell group, and a polarity inversion period cycle of the second liquid crystal cell group, to be shifted from each other. As a result, a polarity of the data voltage, which is charged in the liquid crystal cells of the first liquid crystal cell group, is equally maintained for the two frame periods while a polarity of the data voltage, which is charged in the liquid crystal cells of the second liquid crystal cell group, is inverted one time. In addition, the location of the first liquid crystal cell group and the location of the second liquid crystal cell group are swapped with each other for each frame. A polarity pattern of the data voltage, which is charged in the first liquid crystal cell group and the second liquid crystal cell group, is repeated for each four frames, for example.

The first liquid crystal cell group is charged with a data voltage having the same polarity for two frame periods to prevent DC image sticking, and a polarity of the second liquid crystal cell group is inverted each time for the two frame periods to increase a spatial frequency, thereby preventing a flicker phenomenon. The principle of preventing DC image sticking by driving the first liquid crystal cell group in accordance with the present invention is explained as follows in conjunction with FIG. 6.

Figure 6:
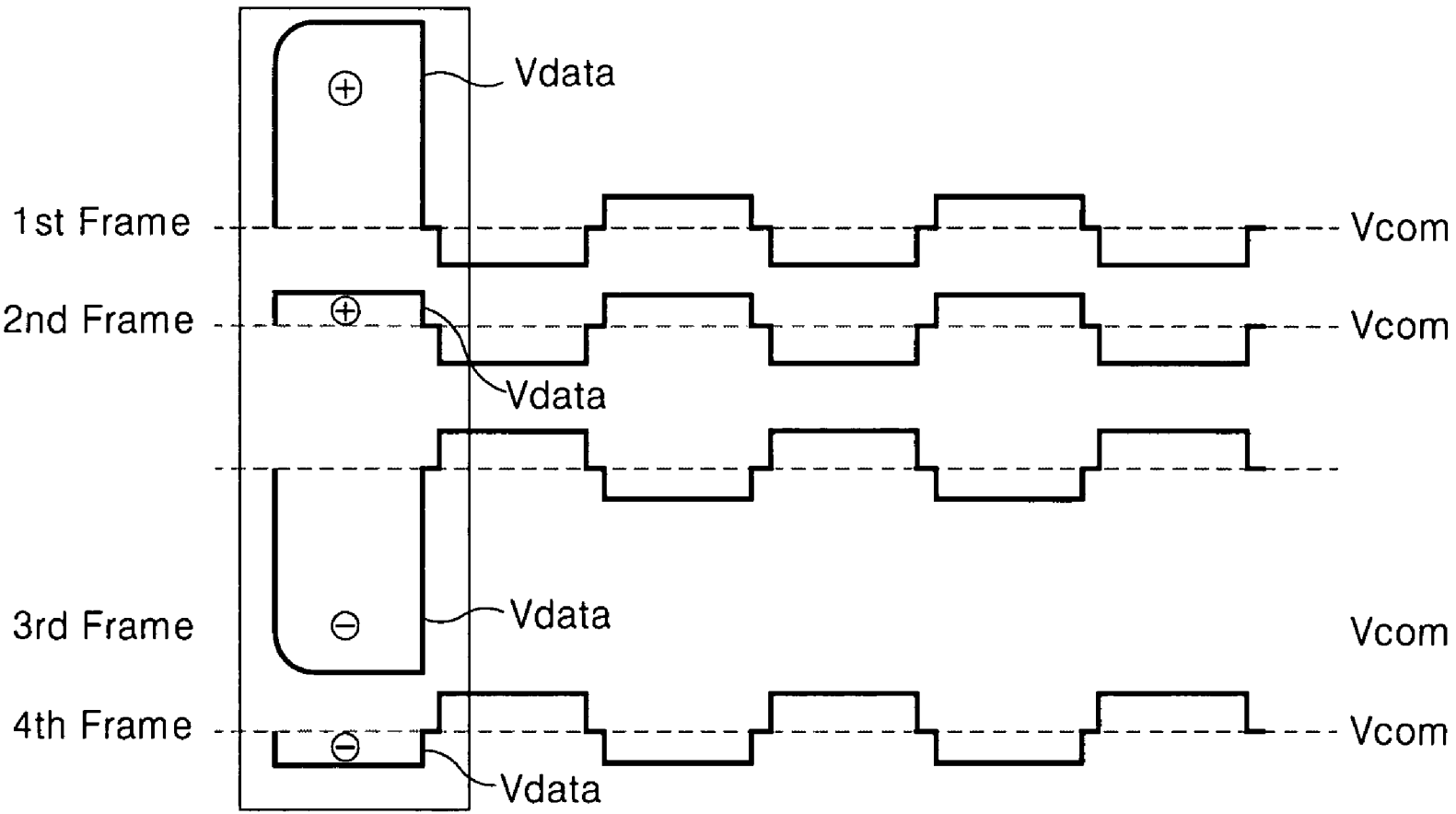
FIG. 6 is an exemplary waveform diagram illustrating the principle of preventing DC image sticking by a first liquid crystal cell group shown in FIG. 5.

As shown in FIG. 6, an arbitrary liquid crystal cell Clc in the first liquid crystal cell group is supplied with a high data voltage for an odd-numbered frame period and with a relatively low data voltage for an even-numbered frame period, and the polarities of the data voltages are changed for each two frame periods. Accordingly, positive data voltages supplied to the liquid crystal cell Clc of the first liquid crystal cell group for first and second frame periods and negative data voltages supplied to the same liquid crystal cell Clc of the first liquid crystal cell group for third and fourth frame periods cancel each other, thereby preventing a voltage of a biased polarity from accumulating in the liquid crystal cell Clc. Accordingly, in the liquid crystal display of the present invention, no DC image sticking is generated by the first liquid crystal cell group even if the data voltage is a high voltage and the polarity is dominant (i.e., in a data voltage of an interlaced picture in any one of an odd-numbered frame and an even-numbered frame) as shown in FIG. 6.

The first liquid crystal cell group may prevent DC image sticking from occurring, but the data voltages of the same polarity are supplied to the liquid crystal cell Clc for each two frame periods. Consequently, flicker may appear. To this end, the liquid crystal cells Clc of the second liquid crystal cell group are charged with a data voltage of which the polarity is inverted each time for the two frame periods when the second liquid crystal cell is maintained as the same polarity in order to increase the spatial frequency, thereby minimizing a flicker phenomenon. This is because the perceived drive frequency of the screen is based on the high drive frequency of the second liquid crystal cell group when the first and second liquid crystal cell groups co-exist since human eyes are more sensitive to changes.

Figure 7:
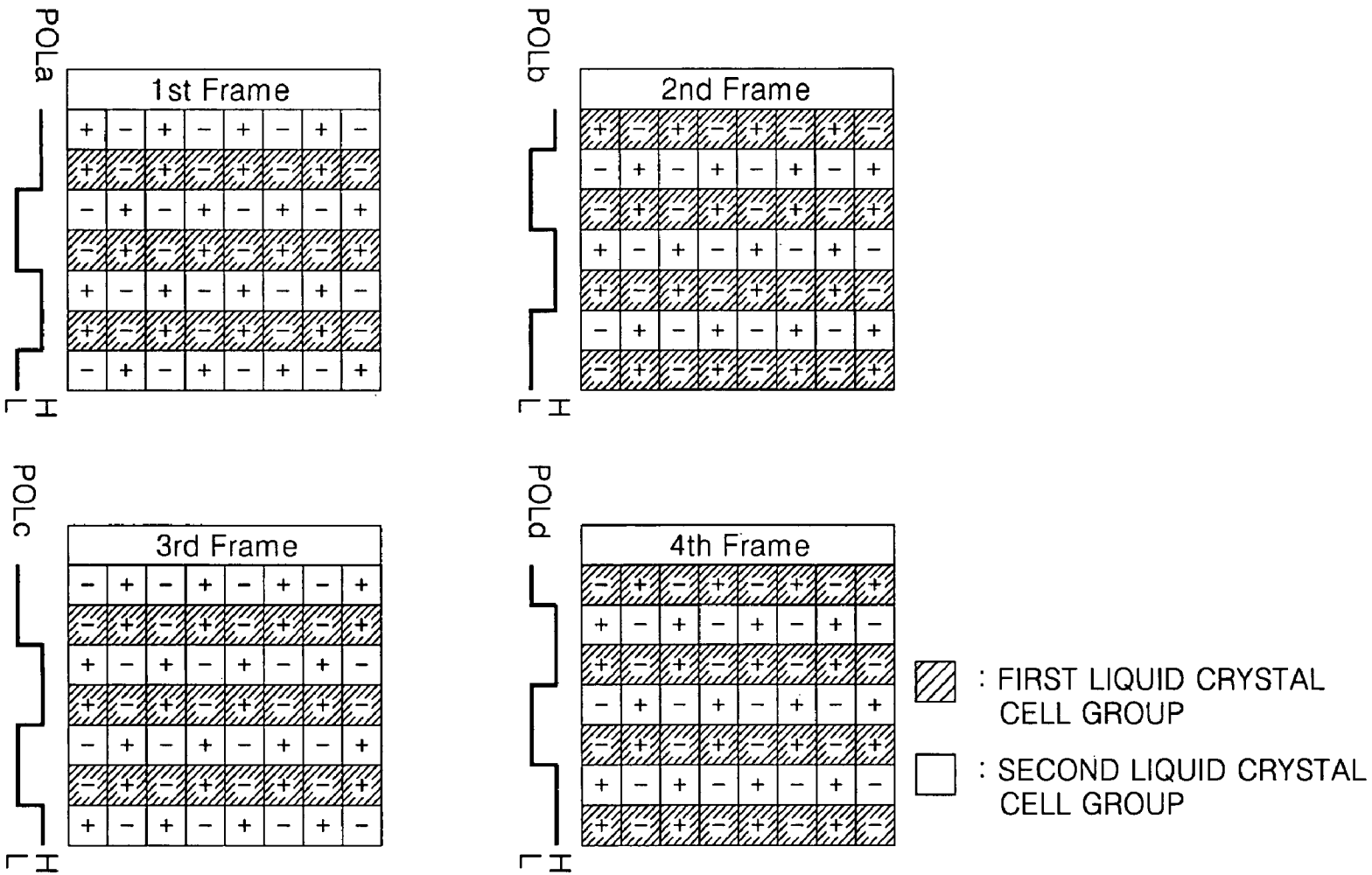
FIG. 7 is a diagram illustrating a first exemplary polarity pattern a data voltage charged in first and second liquid crystal cell groups.
Figure 8:
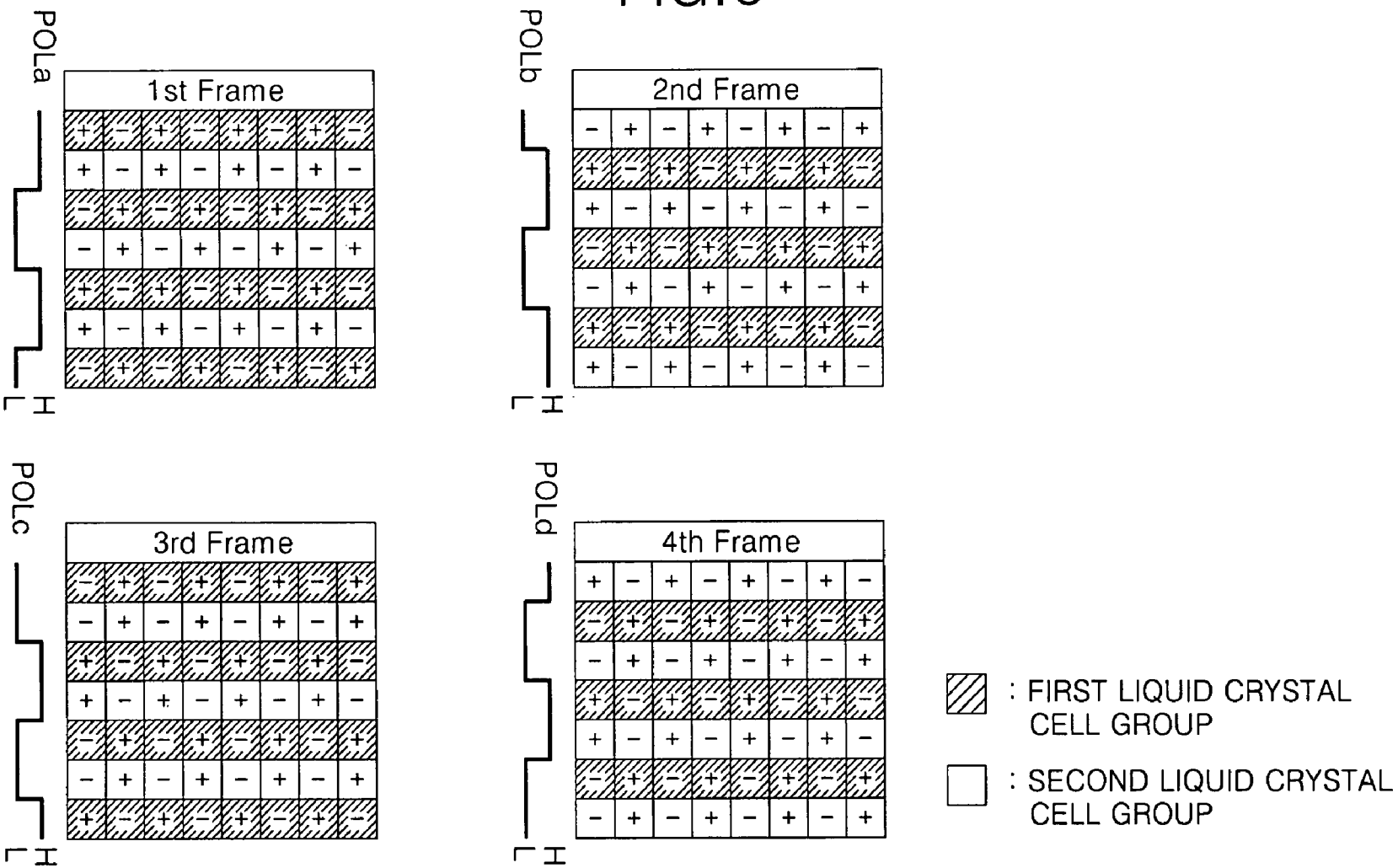
FIG. 8 is a diagram illustrating a second exemplary polarity pattern of a data voltage charged in first and second liquid crystal cell groups.

FIG. 7 and FIG. 8 are diagrams illustrating exemplary polarity patterns of data voltages supplied to the first and second liquid crystal cell groups. As shown in FIGS. 7 and 8, the method of driving the liquid crystal display according to the exemplary embodiment of the present invention repeats the polarity pattern of the data voltages for each four frame periods and moves locations of the first and second liquid crystal cell groups for each frame.

As shown in FIG. 7, for the (4i+1)th frame period (where i is a positive integer), the first liquid crystal cell group includes liquid crystal cells Clc of even-numbered horizontal lines and the second liquid crystal cell group includes liquid crystal cells Cls of odd-numbered horizontal lines. For the (4i+1)th frame period, polarities of the data voltages charged in the liquid crystal cells Clc of the first liquid crystal cell group which are adjacent in a vertical direction with the liquid crystal cells Clc of the second liquid crystal cell group interposed therebetween are opposite to each other. In addition, the polarities of the data voltages charged in the liquid crystal cells Clc of the first liquid crystal cell group adjacent in a horizontal direction are opposite to each other. In the same manner, for the (4i+1)th frame period, the polarities of the data voltages charged in the liquid crystal cells Clc of the second liquid crystal cell group which are adjacent in the vertical direction with the liquid crystal cells Clc of the first liquid crystal cell group interposed therebetween are opposite to each other. In addition, the polarities of the data voltages charged in the liquid crystal cells Clc of the second liquid crystal cell group adjacent in the horizontal direction are opposite to each other.

For the (4i+2)th frame period, data voltages having a polarity pattern, which is inverted on a polarity pattern of a data voltage of the (4i+1)th frame period, are supplied to the first and second liquid crystal cell groups. The first liquid crystal cell group of the (4i+1)th frame period is changed to be the second liquid crystal cell group in the (4i+2)th frame period, and the second liquid crystal cell group of the (4i+1)th frame period is changed to be the first liquid crystal cell group in the (4i+2)th frame period. Accordingly, the first liquid crystal cell group includes the liquid crystal cells Clc of the odd-numbered horizontal lines and the second liquid crystal cell group includes the liquid crystal cells Cls of the even-numbered horizontal lines in the (4i+2)th frame period. For the (4i+2)th frame period, the polarities of the data voltages charged in the liquid crystal cells Clc of the first liquid crystal cell group which are adjacent in the vertical direction with the liquid crystal cells Clc of the second liquid crystal cell group interposed therebetween are opposite to each other. In addition, the polarities of the data voltages charged in the liquid crystal cells Clc of the first liquid crystal cell group adjacent in the horizontal direction are opposite to each other. In the same manner, for the (4i+2)th frame period, the polarities of the data voltages charged in the liquid crystal cells Clc of the second liquid crystal cell group which are adjacent in the vertical direction with the liquid crystal cells Clc of the first liquid crystal cell group interposed therebetween are opposite to each other. In addition, the polarities of the data voltages charged in the liquid crystal cells Clc of the second liquid crystal cell group adjacent in the horizontal direction are opposite to each other.

For the (4i+3)th frame period, data voltages having a polarity pattern, which is inverted on a polarity pattern of a data voltage of the (4i+2)th frame period, are supplied to the first and second liquid crystal cell groups. The first liquid crystal cell group of the (4i+2)th frame period is changed to be the second liquid crystal cell group in the (4i+3)th frame period, and the second liquid crystal cell group of the (4i+2)th frame period is changed to be the first liquid crystal cell group in the (4i+3)th frame period. Accordingly, the first liquid crystal cell group includes the liquid crystal cells Clc of the even-numbered horizontal lines and the second liquid crystal cell group includes the liquid crystal cells Cls of the odd-numbered horizontal lines in the (4i+3)th frame period. For the (4i+3)th frame period, the polarities of the data voltages charged in the liquid crystal cells Clc of the first liquid crystal cell group which are adjacent in the vertical direction with the liquid crystal cells Clc of the second liquid crystal cell group interposed therebetween are opposite to each other. In addition, the polarities of the data voltages charged in the liquid crystal cells Clc of the first liquid crystal cell group adjacent in the horizontal direction are opposite to each other. In the same manner, for the (4i+3)th frame period, the polarities of the data voltages charged in the liquid crystal cells Clc of the second liquid crystal cell group which are adjacent in the vertical direction with the liquid crystal cells Clc of the first liquid crystal cell group interposed therebetween are opposite to each other. In addition, the polarities of the data voltages charged in the liquid crystal cells Clc of the second liquid crystal cell group adjacent in the horizontal direction are opposite to each other. As can be seen in the comparison of the polarity pattern of the data voltages of the (4i+3)th frame period and the polarity pattern of the data voltages of the (4i+1)th frame period, locations of the first and second liquid crystal cell groups are the same in the (4i+1)th frame period and the (4i+3)th frame period, but the polarities of the data voltages are different from each other.

For the (4i+4)th frame period, data voltages having a polarity pattern, which is inverted on a polarity pattern of a data voltage of the (4i+3)th frame period, are supplied to the first and second liquid crystal cell groups. The first liquid crystal cell group of the (4i+3)th frame period is changed to be the second liquid crystal cell group in the (4i+4)th frame period, and the second liquid crystal cell group of the (4i+3)th frame period is changed to be the first liquid crystal cell group in the (4i+4)th frame period. Accordingly, the first liquid crystal cell group includes the liquid crystal cells Clc of the odd-numbered horizontal lines and the second liquid crystal cell group includes the liquid crystal cells Cls of the even-numbered horizontal lines in the (4i+4)th frame period. For the (4i+4)th frame period, the polarities of the data voltages charged in the liquid crystal cells Clc of the first liquid crystal cell group which are adjacent in the vertical direction with the liquid crystal cells Clc of the second liquid crystal cell group interposed therebetween are opposite to each other. In addition, the polarities of the data voltages charged in the liquid crystal cells Clc of the first liquid crystal cell group adjacent in the horizontal direction are opposite to each other. In the same manner, for the (4i+4)th frame period, the polarities of the data voltages charged in the liquid crystal cells Clc of the second liquid crystal cell group which are adjacent in the vertical direction with the liquid crystal cells Clc of the first liquid crystal cell group interposed therebetween are opposite to each other. In addition, the polarities of the data voltages charged in the liquid crystal cells Clc of the second liquid crystal cell group adjacent in the horizontal direction are opposite to each other. As can be seen in the comparison of the polarity pattern of the data voltages of the (4i+4)th frame period and the polarity pattern of the data voltages of the (4i+2)th frame period, locations of the first and second liquid crystal cell groups are the same in the (4i+2)th frame period and the (4i+4)th frame period, but the polarities of the data voltages are different from each other.

A first polarity control signal POLa generated in the (4i+1)th frame period has a phase that is opposite of a third polarity control signal POLc generated in the (4i+3)th frame period. A second polarity control signal POLb generated in the (4i+2)th frame period has a phase that is opposite with a fourth polarity control signal POLd generated in the (4i+4)th frame period. The first polarity control signal POLa and the second polarity control signal POLb has a phase difference of about one horizontal period, and the third polarity control signal POLc and the fourth polarity control signal POLd also has a phase difference of about one horizontal period.

As shown in FIG. 8, for the (4i+1)th frame period, the first liquid crystal cell group includes liquid crystal cells Clc of odd-numbered horizontal lines and the second liquid crystal cell group includes liquid crystal cells Cls of even-numbered horizontal lines. For the (4i+1)th frame period, polarities of the data voltages charged in the liquid crystal cells Clc of the first liquid crystal cell group which are adjacent in a vertical direction with the liquid crystal cells Clc of the second liquid crystal cell group interposed therebetween are opposite to each other. In addition, the polarities of the data voltages charged in the liquid crystal cells Clc of the first liquid crystal cell group adjacent in a horizontal direction are opposite to each other. In the same manner, for the (4i+1)th frame period, the polarities of the data voltages charged in the liquid crystal cells Clc of the second liquid crystal cell group which are adjacent in the vertical direction with the liquid crystal cells Clc of the first liquid crystal cell group interposed therebetween are opposite to each other. In addition, the polarities of the data voltages charged in the liquid crystal cells Clc of the second liquid crystal cell group adjacent in the horizontal direction are contrary to each other.

For the (4i+2)th frame period, data voltages having a polarity pattern, which is inverted on a polarity pattern of a data voltage of the (4i+1)th frame period, are supplied to the first and second liquid crystal cell groups. The first liquid crystal cell group of the (4i+1)th frame period is changed to be the second liquid crystal cell group in the (4i+2)th frame period, and the second liquid crystal cell group of the (4i+1)th frame period is changed to be the first liquid crystal cell group in the (4i+2)th frame period. Accordingly, the first liquid crystal cell group includes the liquid crystal cells Clc of the even-numbered horizontal lines and the second liquid crystal cell group includes the liquid crystal cells Cls of the odd-numbered horizontal lines in the (4i+2)th frame period. For the (4i+2)th frame period, the polarities of the data voltages charged in the liquid crystal cells Clc of the first liquid crystal cell group which are adjacent in the vertical direction with the liquid crystal cells Clc of the second liquid crystal cell group interposed therebetween are opposite to each other. In addition, the polarities of the data voltages charged in the liquid crystal cells Clc of the first liquid crystal cell group adjacent in the horizontal direction are opposite to each other. In the same manner, for the (4i+2)th frame period, the polarities of the data voltages charged in the liquid crystal cells Clc of the second liquid crystal cell group which are adjacent in the vertical direction with the liquid crystal cells Clc of the first liquid crystal cell group interposed therebetween are opposite to each other. In addition, the polarities of the data voltages charged in the liquid crystal cells Clc of the second liquid crystal cell group adjacent in the horizontal direction are contrary to each other.

For the (4i+3)th frame period, data voltages having a polarity pattern, which is inverted on a polarity pattern of a data voltage of the (4i+2)th frame period, are supplied to the first and second liquid crystal cell groups. The first liquid crystal cell group of the (4i+2)th frame period is changed to be the second liquid crystal cell group in the (4i+3)th frame period, and the second liquid crystal cell group of the (4i+2)th frame period is changed to be the first liquid crystal cell group in the (4i+3)th frame period. Accordingly, the first liquid crystal cell group includes the liquid crystal cells Clc of the odd-numbered horizontal lines and the second liquid crystal cell group includes the liquid crystal cells Cls of the even-numbered horizontal lines in the (4i+3)th frame period. For the (4i+3)th frame period, the polarities of the data voltages charged in the liquid crystal cells Clc of the first liquid crystal cell group which are adjacent in the vertical direction with the liquid crystal cells Clc of the second liquid crystal cell group interposed therebetween are opposite to each other. In addition, the polarities of the data voltages charged in the liquid crystal cells Clc of the first liquid crystal cell group adjacent in the horizontal direction are opposite to each other. In the same manner, for the (4i+3)th frame period, the polarities of the data voltages charged in the liquid crystal cells Clc of the second liquid crystal cell group which are adjacent in the vertical direction with the liquid crystal cells Clc of the first liquid crystal cell group interposed therebetween are opposite to each other. In addition, the polarities of the data voltages charged in the liquid crystal cells Clc of the second liquid crystal cell group adjacent in the horizontal direction are opposite to each other. Locations of the first and second liquid crystal cell groups are the same in the (4i+1)th frame period and the (4i+3)th frame period, but the polarities of the data voltages are different from each other.

For the (4i+4)th frame period, data voltages having a polarity pattern, which is inverted on a polarity pattern of a data voltage of the (4i+3)th frame period, are supplied to the first and second liquid crystal cell groups. The first liquid crystal cell group of the (4i+3)th frame period is changed to be the second liquid crystal cell group in the (4i+4)th frame period, and the second liquid crystal cell group of the (4i+3)th frame period is changed to be the first liquid crystal cell group in the (4i+4)th frame period. Accordingly, the first liquid crystal cell group includes the liquid crystal cells Clc of the even-numbered horizontal lines and the second liquid crystal cell group includes the liquid crystal cells Cls of the odd-numbered horizontal lines in the (4i+4)th frame period. For the (4i+4)th frame period, the polarities of the data voltages charged in the liquid crystal cells Clc of the first liquid crystal cell group which are adjacent in the vertical direction with the liquid crystal cells Clc of the second liquid crystal cell group interposed therebetween are opposite to each other. In addition, the polarities of the data voltages charged in the liquid crystal cells Clc of the first liquid crystal cell group adjacent in the horizontal direction are opposite to each other. In the same manner, for the (4i+4)th frame period, the polarities of the data voltages charged in the liquid crystal cells Clc of the second liquid crystal cell group-which are adjacent in the vertical direction with the liquid crystal cells Clc of the first liquid crystal cell group interposed therebetween are opposite to each other. In addition, the polarities of the data voltages charged in the liquid crystal cells Clc of the second liquid crystal cell group adjacent in the horizontal direction are opposite to each other. Locations of the first and second liquid crystal cell groups are the same in the (4i+2)th frame period and the (4i+4)th frame period, but the polarities of the data voltages are different from each other.

The second and fourth polarity control signals POLb, POLd among the polarity control signals POLa to POLd for controlling the polarity pattern of the data voltages of FIG. 8 have phases that are opposite of the second and fourth polarity control signals POLb and POLd of FIG. 7.

The liquid crystal cells Clc of the first liquid crystal cell group have a relatively long polarity change cycle. Thus, it is possible that flickers may occur if the liquid crystal cells are spatially arranged in a concentrated manner. Accordingly, in the method of driving the liquid crystal display according to the exemplary embodiment of the present invention, the liquid crystal cells Clc of the first liquid crystal cell group control the polarity of the data voltages for not less than two horizontal lines to be continuous in each frame period, as shown in FIG. 7 and FIG. 8. Further, if the location of the first liquid crystal cell group is the same for not less than three frame periods, a brightness difference with another horizontal line may occur, thereby generating a rippling noise effect. Accordingly, the exemplary method of driving the liquid crystal display according to the present invention controls the first liquid crystal cell group to alternate with the second liquid crystal cell group for each frame period, as shown in FIG. 7 and FIG. 8.

Figure 9:
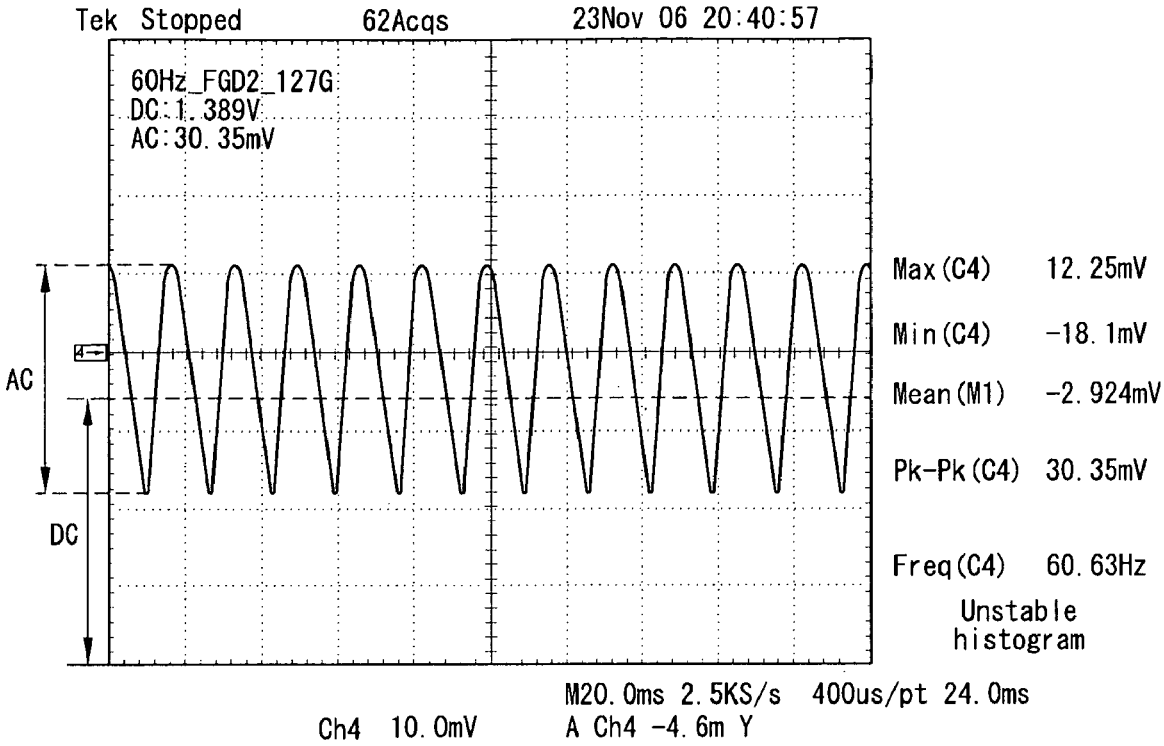
FIG. 9 is an exemplary waveform diagram illustrating a DC offset value and an AC value of a data voltage measured in a liquid crystal display panel supplied with the data voltages of FIG. 7 and FIG. 8.

FIG. 9 shows a result of an experiment when data voltages of 127 gray levels are supplied to a liquid crystal display panel with a polarity pattern shown in FIG. 7 and FIG. 8 and a voltage waveform of the liquid crystal display panel is measured. In this experiment, the second liquid crystal cell group of the liquid crystal display panel is supplied with the data voltage of which the polarity is changed at a frequency of 60 Hz within two frame period, and the first liquid crystal cell group is supplied with the data voltage of which the polarity is changed at a frequency of 30 Hz. However, because the faster frequency of 60 Hz is perceived to be more dominant, the frequency of the data voltage measured in the liquid crystal display panel is measured to be 60 Hz. For this experiment, an AC voltage value, i.e., an amplitude, of the data voltage is 30.35 mV, and a DC offset value between the center of the AC voltage and a ground voltage GND is measured to be 1.389 V. Further, measuring a light waveform by installing an optical sensor on a sample liquid crystal display panel revealed that the light waveform of the liquid crystal display panel was also measured to be 60 Hz due to the dominant frequency of the second liquid crystal cell group. This is because the light waveform measured in the liquid crystal display panel was determined by a light change cycle of the second liquid crystal cell group, which had a frequency that was faster than that of the first liquid crystal cell group.

In some instances, even if the data polarity period of the first liquid crystal cell group is extended to two frame periods and data having the same gray scale level are applied to the liquid crystal cell, the charge amount of the positive data voltage and the charge amount of the negative data voltage in the liquid crystal cell may not be the same. Thus, the location of the first liquid crystal cell group is changed for each frame, so that the brightness of the liquid crystal cells of the first liquid crystal cell group may be increased.

Figure 10:
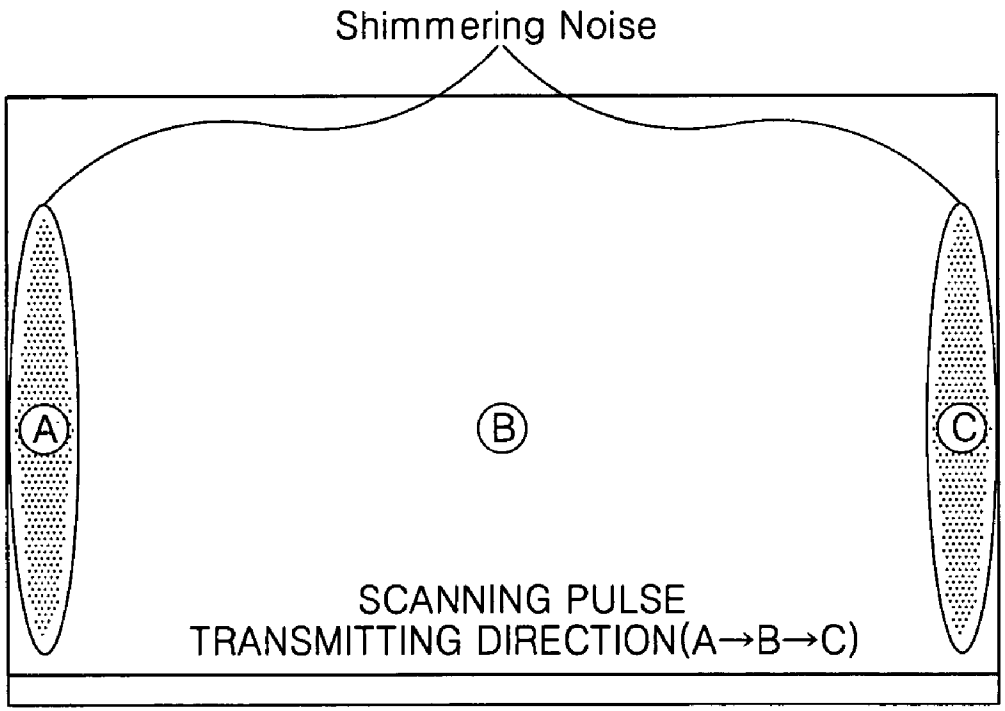
FIG. 10 is a diagram illustrating a shimmering noise effect.

To alleviate this phenomenon, a method of adjusting a common voltage Vcom supplied to common electrodes of all liquid crystal cells has been developed. However, since the common electrodes are commonly connected to all liquid crystal cells, a voltage drop of the common voltage may vary depending on the location of the screen due to surface resistance or linear resistance of the common electrode. Furthermore, a voltage of the scanning pulse applied to the gate line may vary due to resistance of the gate line depending on the location of the screen. Thus, if the common voltage Vcom is optimized in reference to the center (B) of the screen as shown in FIG. 10, a shimmering noise effect of bright waving points may be generated along the side portions (A) and (C) of the screen. On the other hand, if the common voltage Vcom is optimized in reference to both of the side portions (A) and (C) of the screen, the shimmering noise effect is generated at the center (B) of the screen. This is because a voltage drop of the scanning pulse SP increases at location (C) due to resistances of the gate lines since these liquid crystal cells are the farthest from the gate driving circuit.

To reduce the shimmering noise effect, the method of driving the liquid crystal display in accordance with the exemplary embodiment of the present invention supplying a data voltage having a polarity pattern shown in FIG. 7 and FIG. 8 to the data lines to drive the liquid crystal display panel with the first and second liquid crystal cell groups was repeated in order to adjust (i.e., fine tune) the common voltage and a voltage of the scanning pulse. Based on the result, a method of modulating a scanning pulse in accordance with an exemplary embodiment of the present invention was developed to modulate down the voltage of the scanning pulse in the vicinity of the falling edge of the scanning pulse and optimize the timing of when the modulated voltage is applied. As a result, experiments confirm that DC image sticking and the shimmering noise effect are removed for the entire screen. A detailed description on the exemplary method of modulating the scanning pulse is described further below.

Figure 11:
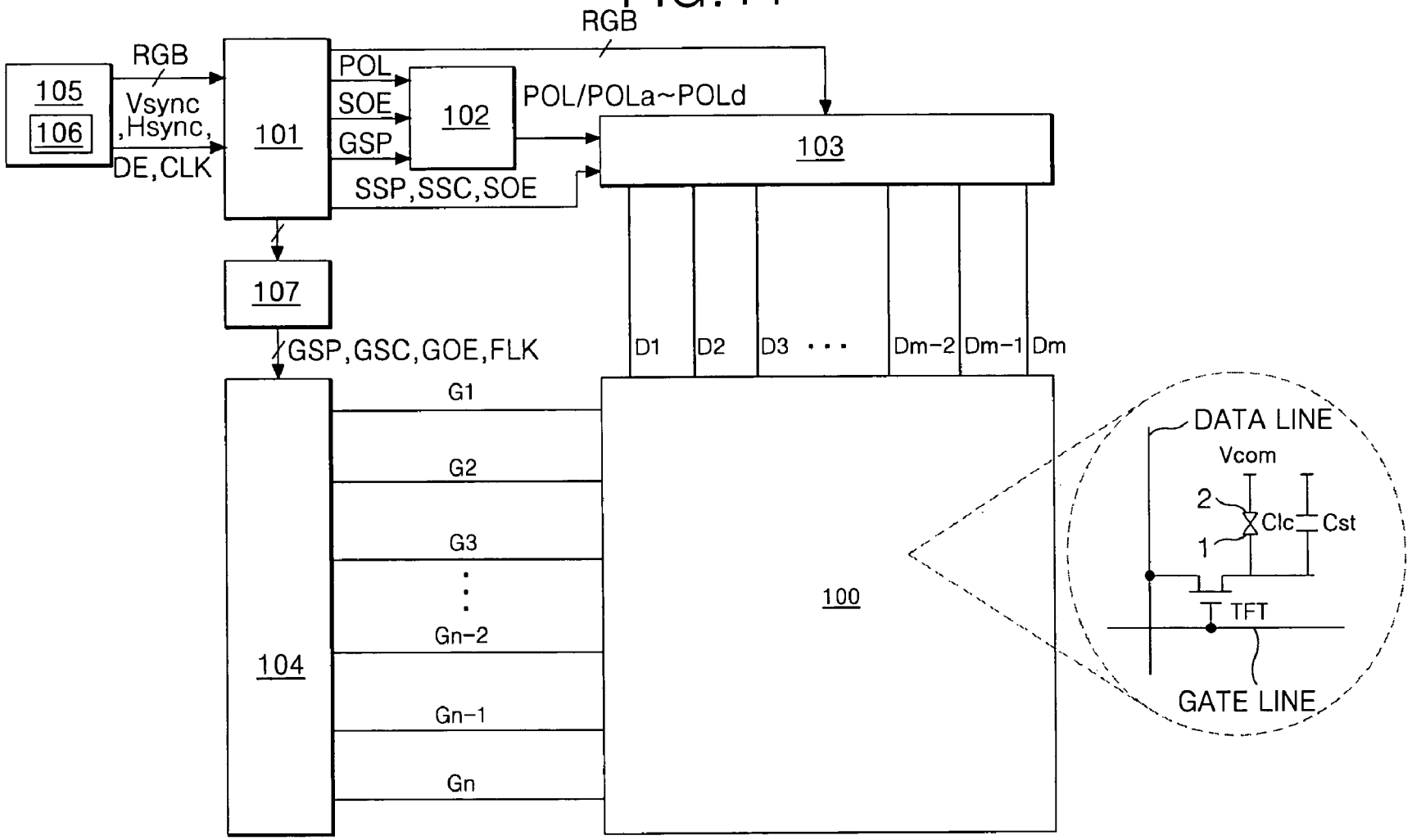
FIG. 11 is a block diagram illustrating an exemplary liquid crystal display according to the first embodiment of the present invention.

FIG. 11 to FIG. 16 illustrate an exemplary liquid crystal display according to an embodiment of the present invention. As shown in FIG. 11, the exemplary liquid crystal display according to the embodiment of the present invention includes a liquid crystal display panel 100, a timing controller 101, a POL logic circuit 102, a FLK logic circuit 107, a data driving circuit 103, and a gate driving circuit 104. In the liquid crystal display panel 100, liquid crystal molecules are injected between two glass substrates. The liquid crystal display panel 100 includes m×n number of liquid crystal cells Clc arranged in a matrix pattern where m number of data lines D1 to Dm and n number of gate lines G1 to Gn cross each other. The liquid crystal cells Clc includes first and second liquid crystal cell groups that are driven at different data voltage frequencies as described above. On the first glass substrate of the liquid crystal display panel 100, there are formed data lines D1 to Dm, gate lines G1 to Gn, TFTs, pixel electrodes 1 of the liquid crystal cells Clc connected to the TFTs, storage capacitors Cst, and other components. On the second glass substrate of the liquid crystal display panel 100, there are formed a black matrix, color filters, and a common electrode 2. It is to be understood that the common electrode 2 may formed on the second glass substrate in a vertical electric field driving method such as a TN (Twisted Nematic) mode and a VA (Vertical Alignment) mode or formed together with the pixel electrode 1 on the first glass substrate in a horizontal electric field driving method, such as an IPS (In-Plane Switching) mode and an FFS (Fringe Field Switching) mode. Polarizers With optical axes crossing perpendicularly with each other are attached to the first and second glass substrates of the liquid crystal display panel 100, and alignment films for setting the pre-tilt angle of liquid crystals are formed on the internal surfaces thereof that face the liquid crystals.

The timing controller 101 receives timing signals, such as vertical/horizontal synchronization signals Vsync, Hsync, data enables, clock signals, and other signals to generate control signals for controlling the operation timing of the POL logic circuit 102, the gate driving circuit 104, and the data driving circuit 103. The control signals include a gate start pulse GSP, a gate shift clock signal GSC, a gate output enable signal GOE, a source start pulse SSP, a source sampling clock SSC, a source output enable signal SOE, and a reference polarity control signal POL. The gate start pulse GSP indicates a start horizontal line from which a scan starts among a first vertical period when a screen is displayed. The gate shift clock signal GSC is input to a shift register within the gate driving circuit and is generated to have a pulse width corresponding to the on-period of the TFT as a timing control signal for sequentially shifting the gate start pulse GSP. The gate output enable signal GOE indicates the output of the gate driving circuit 104. The source start pulse SSP indicates a start pixel in a first horizontal line where data are to be displayed. The source sampling clock SSC indicates a latch operation of the data within the data driving circuit 103 on the basis of a rising or falling edge. The source output enable signal SOE indicates the output of the data driving circuit 103. The reference polarity control signal POL indicates the polarity of the data voltages which are to be supplied to the liquid crystal cells Clc, of the liquid crystal display panel 100. The reference polarity control signal POL may be generated in any one of one-dot inversion polarity control signal where the logic is inverted for each horizontal period and tw-dot inversion polarity control signal where the logic is inverted every two horizontal periods.

The POL logic circuit 102 receives the gate start pulse GSP, the source output enable signal SOE, and the reference polarity control signal POL and sequentially outputs the polarity control signals POLa to POLd of the (4i+1)th to the (4i+4)th frame periods to prevent the residual images and flickers, or selectively outputs the same reference polarity control signal POL for each frame. The FLK logic circuit 107 receives the gate shift clock GSC to generate a control signal FLK for modulating a scanning pulse which is synchronized with a rising edge of the gate shift clock GSC and has a pulse width wider than the gate shift clock GSC. The POL logic circuit 102 and the FLK logic circuit 107 may be embedded within the timing controller 101.

The data driving circuit 103 latches digital video data RGB under control of the timing controller 101. In addition, the data driving circuit 103 converts the digital video data RGB into analog positive/negative gamma compensation voltage in response to the polarity control signal POL/POLa-POLd from the timing controller 101 to generate a positive/negative analog data voltage, thereby supplying the data voltage to the data lines D1 to Dm.

Figure 16:
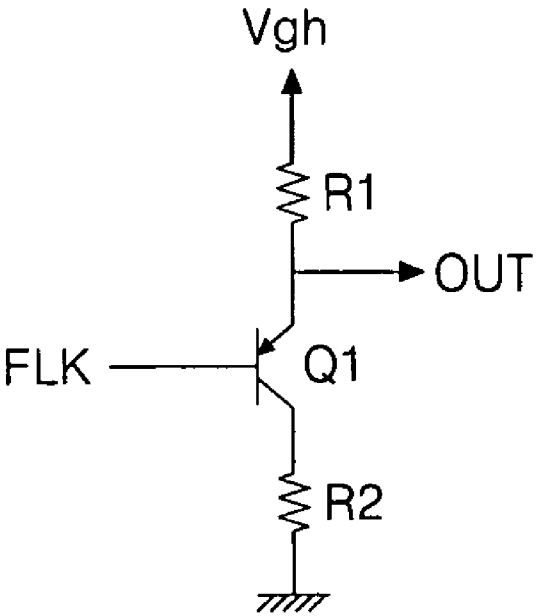
FIG. 16 is an exemplary circuit diagram illustrating the modulation circuit within the gate driving circuit shown in FIG. 11.

The gate driving circuit 104 includes a plurality of gate drive integrated circuits ("ICs"), each including a shift register, a level shifter for converting the swing width of the output signal of the shift register into a swing width that is suitable for driving the TFT of the liquid crystal cell, and an output buffer connected between the level shifter and the gate line G1 to Gn. The gate driving circuit 104 sequentially outputs scan pulses which have pulse widths of about one horizontal period. The scanning pulse is swung between a gate high voltage Vgh higher than a threshold voltage of a TFT of a pixel array and a gate low voltage Vgl lower than the threshold voltage of the TFT. In accordance with the exemplary embodiment of the present invention, the gate driving circuit 104 decreases the gate high voltage Vgh near the falling edge of the scanning pulse to the falling edge using the modulation circuit as shown in FIG. 16 to prevent the shimmering noise effect.

The liquid crystal display according to the embodiment of the present invention further includes a video source 105 that supplies the digital video data RGB and the timing signals Vsync, Hsync, DE, and CLK to the timing controller 101. The video source 105 includes a broadcasting signal, an external device interface circuit, a graphic processing circuit, a line memory 106, and other components. The video source 105 extracts the video data from an image source input from the external device or the broadcasting signal and converts the video data into the digital data to supply to the timing controller 101. Interlaced broadcasting signal received in the video source 105 is stored at the line memory 106 and then the stored signal is output. The video data of the interlaced broadcasting signal exist only in the odd-numbered lines for the odd-numbered frame period and only in the even-numbered lines for the even-numbered frame period. Accordingly, if the interlaced broadcasting signal is received, the video source 105 generates black data value or the average value of the effective data stored at the line memory 106 as the even-numbered line data of the odd-numbered frame period and the odd-numbered line data of the even-numbered frame. The video source 105 supplies power and the timing signals Vsync, Hsync, DE, and CLK together with the digital video data to the timing controller 101.

Figure 12:
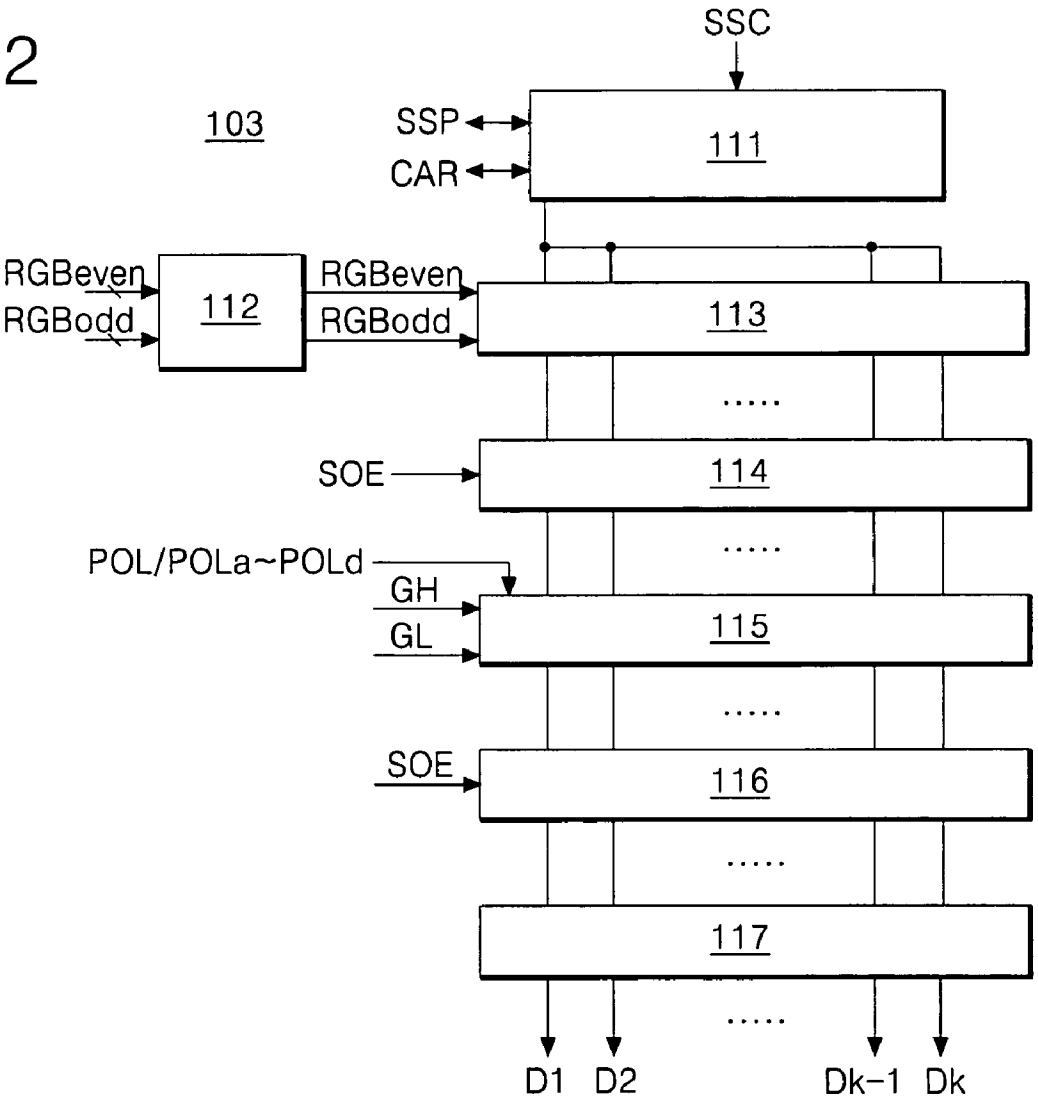
FIG. 12 is an exemplary circuit diagram illustrating the data driving circuit shown in FIG. 11.
Figure 13:
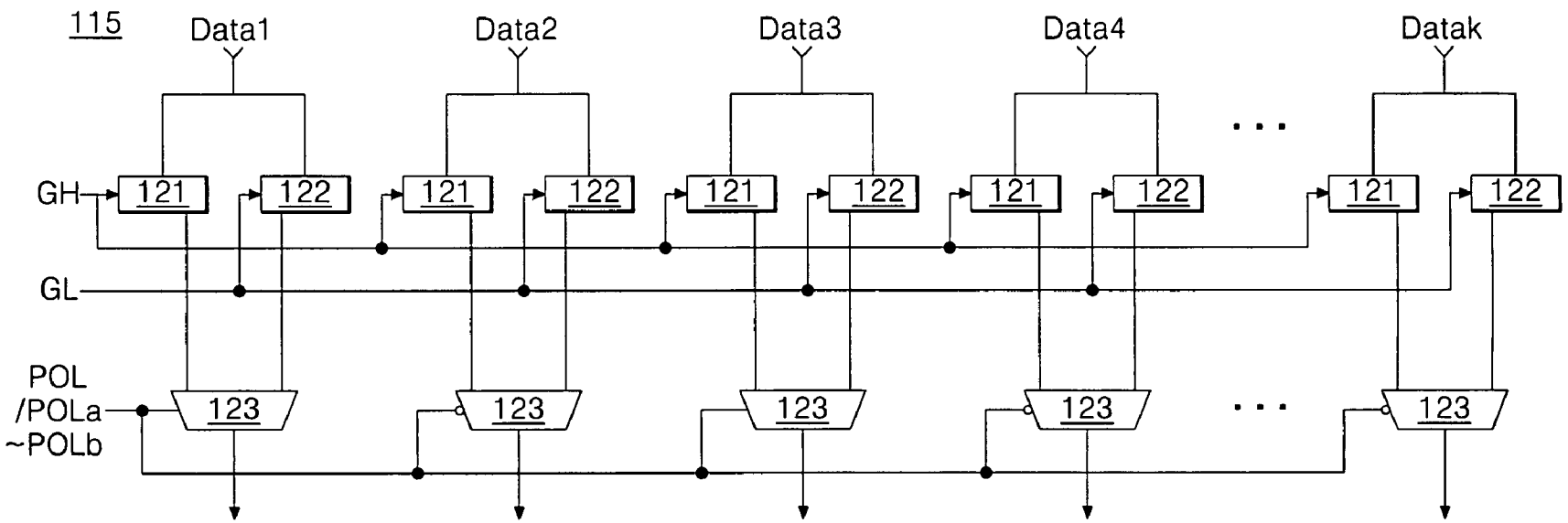
FIG. 13 is an exemplary circuit diagram illustrating the digital/analog converter shown in FIG. 12.

FIG. 12 and FIG. 13 illustrate exemplary circuit diagrams of the data driving circuit 103. As shown in FIGS. 12 and 13, the data driving circuit 103 includes a plurality of integrated circuits (hereinafter, referred to as "IC") each of which drives k number of data lines D1 to Dk (where k is an integer less than m). Each IC includes a shift register 111, a data register 112, a first latch 113, a second latch 114, a digital/analog converter (hereinafter, referred to as "DAC") 115, a charge share circuit 116, and an output circuit 117.

The shift register 111 shifts the source start pulse SSP from the timing controller 101 in accordance with the source sampling clock SSC to generate a sampling signal. Further, the shift register 111 shifts the source start pulse SSP to transmit a carry signal CAR to the shift register 111 of the next stage IC. The data register 112 temporarily stores an odd-numbered digital video data RGBodd and an even-numbered digital video data RGBeven divided by the timing controller 101 and supplies the stored data RGBodd, RGBeven to the first latch 113. The first latch 113 samples the digital video data RGBodd, RGBeven from the data register 112 in response to the sampling signal sequentially input from the shift register 111, latches the data RGBodd, RGBeven, and outputs the data at the same time. The second latch 114 outputs the digital video data latched at the same time as the second latch 114 of other ICs during a low logic period of the source output enable signal SOE after latching the data input from the first latch 113.

As shown in FIG. 13, the DAC 115 includes a P-decoder PDEC 121 supplied with a positive gamma reference voltage GH, an N-decoder NDEC 122 supplied with a negative gamma reference voltage GL, and a multiplexer which selects between the output of the P-decoder 121 and the output of the N-decoder 122 in response to the polarity control signals POL/POLa-POLd. The P-decoder 121 decodes the digital video data input from the second latch 114 to output a positive gamma compensation voltage corresponding to a gray level value of the data, and the N-decoder 122 decodes the digital video data input from the second latch 114 to output a negative gamma compensation voltage corresponding to a gray level value of the data. The multiplexer 123 alternately selects between the positive gamma compensation voltage and the negative gamma compensation voltage in response to the polarity control signal POL/POLa-POLd and outputs the selected positive/negative gamma compensation voltage as the analog data voltage.

As shown in FIG. 12, the charge share circuit 116 shorts adjacent data output channels for a high logic period of the source output enable signal SOE to output an average value of the adjacent data voltages or supplies a common voltage Vcom to the data output channels during the high logic period of the source output enable signal SOE to reduce a rapid change of the positive and negative data voltages. The output circuit 117 includes a buffer and minimizes a signal attenuation of the analog data voltage supplied to the data line D1 to Dk.

Figure 14:
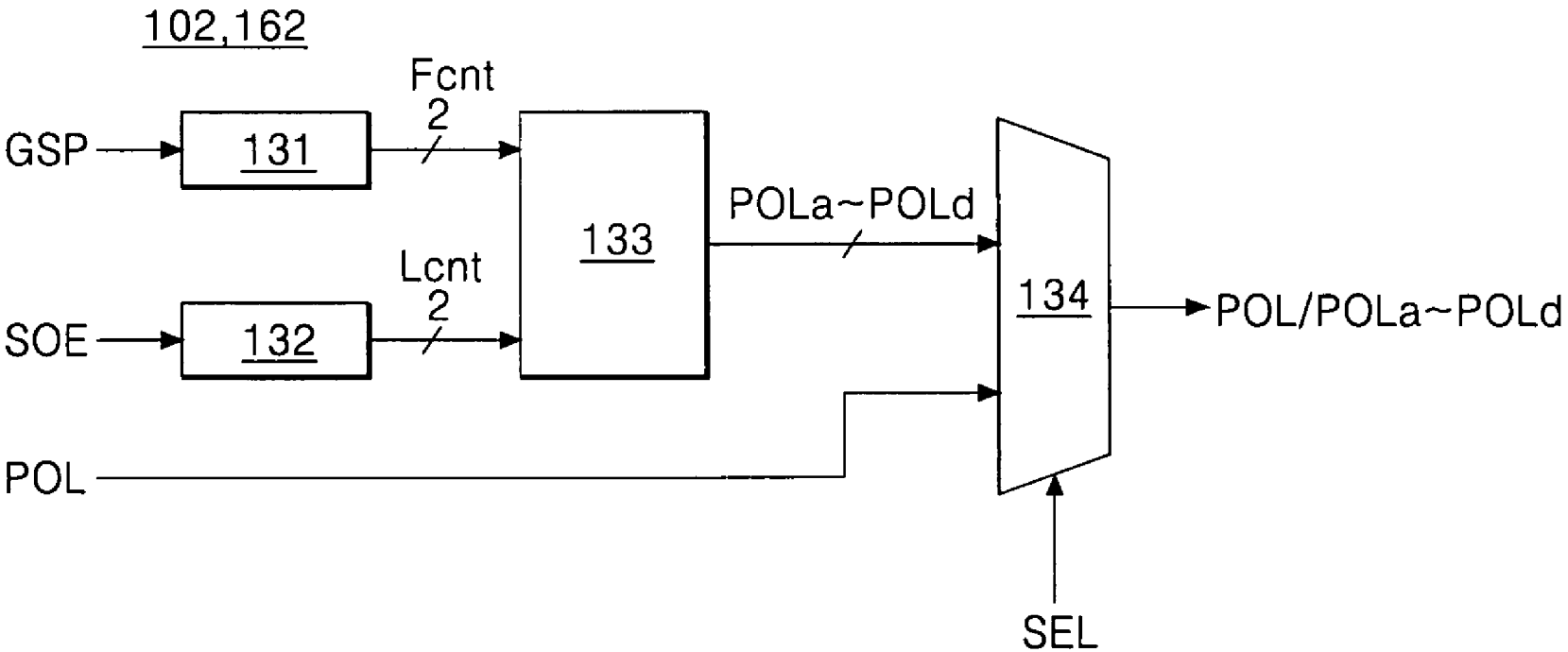
FIG. 14 is an exemplary circuit diagram illustrating the POL logic circuit in FIG. 11.
Figure 15:
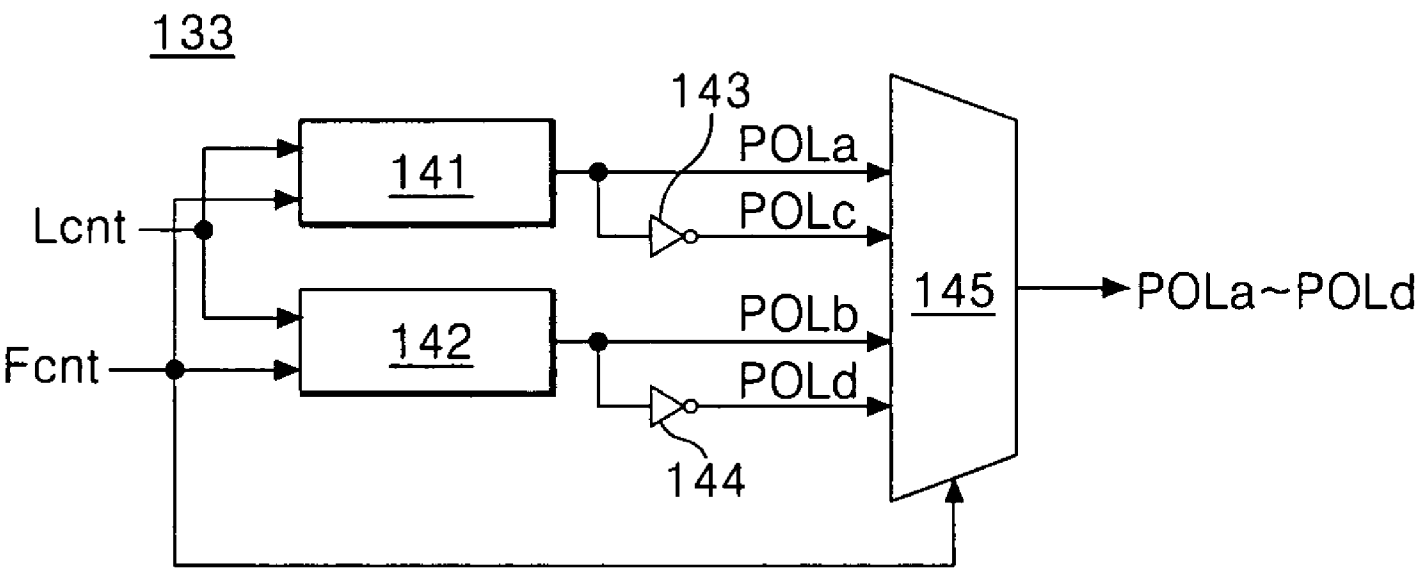
FIG. 15 is an exemplary circuit diagram illustrating the POL generating circuit in FIG. 12.

FIGS. 14 and 15 illustrate exemplary circuit diagrams of the POL logic circuit 102. As shown in FIG. 13 and FIG. 14, the POL logic circuit 102 includes a frame counter 131, a line counter 132, a POL generation circuit 133, and a multiplexer 134. The frame counter 131 outputs a frame count information Fcnt indicating the number of frames of a picture that is to be displayed in the liquid crystal display panel 100 in response to the gate start pulse GSP generated once for one frame period at the same time as a start of the frame period. The frame count information Fcnt is generated as a 2-bit information, for example, so as to be able to identify each of four frame periods in conjunction with the polarity patterns of the data voltages are generated as shown in FIG. 7 and FIG. 8. However, different number of bits may be used without departing from the scope of the present invention.

The line counter 132 outputs a line count information Lcnt indicating a horizontal line that is to be displayed in the liquid crystal display panel 100 in response to the source output enable signal SOE which indicates a time when the data voltage is supplied to each horizontal line. The line count information Lcnt is generated as a 2-bit information, for example, because the polarity of the data voltage displayed in the liquid crystal display panel 100 is inverted for each one horizontal line or every two horizontal lines, as in the polarity patterns of the data voltages shown in FIG. 7 and FIG. 8. However, different number of bits may be used without departing from the scope of the present invention.

For the timing signal to be supplied to the frame counter 131 and the line counter 132, a clock generated from an internal oscillator of the timing controller 101 may be used. However, the clock may increase an electromagnetic interference (EMI) between the timing controller 101 and the POL logic circuit 102 because of the high frequency of the clock. In accordance with the present invention, the increase of EMI between the timing controller 101 and the POL logic circuit 102 may be reduced by using the source output enable signal SOE and the gate start pulse GSP, the frequency of which is lower than that of the clock generated in the internal oscillator of the timing controller 101, as operation timing signals of the frame counter 131 and the line counter 132.

A shown in FIG. 15, the POL generation circuit 133 includes a first POL generation circuit 141, a second POL generation circuit 142, first and second inverters 143, 144, and a multiplexer 145. The first POL generation circuit 141 generates a first polarity control signal POLa, the polarity of which is inverted every two horizontal periods based on the line count information Lcnt. The first inverter 143 inverts the first polarity control signal POLa to generate a third polarity control signal POLc. The second POL generation circuit 142 generates a second polarity control signal POLb, the polarity of which is inverted every two horizontal periods and has a phase difference of about one horizontal period in comparison with the first polarity control signal POLa based on the line count information Lcnt. The second inverter 144 inverts the second polarity control signal POLb to generate a fourth polarity control signal POLd. Each of the first and second POL generation circuits 141, 142 inverts the polarities of the polarity control signals POLb, POLc for each frame period in response to the frame count information Fcnt. The multiplexer 145 outputs the first polarity control signal POLa for the (4i+1)th frame period in response to the frame count information Fcnt of 2 bits, for example, then outputs the second polarity control signal POLb for the (4i+2)th frame period, then outputs the third polarity control signal POLc for the (4i+3)th frame period, and then outputs the fourth polarity control signal POLd for the (4i+4)th frame period.

As shown in FIG. 14, the multiplexer 134 selects the polarity control signals POLa to POL1*d* from the POL generation circuit 133 corresponding to each frame period, as shown in FIG. 7 and FIG. 8, in accordance with a logic value of a control terminal connected to an option pin. The option pin is connected to the control terminal of the multiplexer 134 and may be selectively connected to a ground voltage GND or the power supply voltage Vcc by a manufacturer or user. For example, if the option pin is connected to the ground voltage GND and the control terminal of the multiplexer 134, the multiplexer 134 has a selection control signal SEL of "0" supplied to its own control terminal, thereby outputting the reference polarity control signal POL. If the option pin is connected to the power supply voltage and the control terminal of the multiplexer 134, the multiplexer 134 has a selection control signal SEL of "1" supplied to its own control terminal, thereby outputting the polarity control signals POL1*a* to POLd from the POL generation circuit 133. The selection control signal SEL of the multiplexer 134 may be replaced with a user selection signal, which is input through a user interface, or a selection control signal, which is automatically generated from the timing controller 101 or the video source 105 in accordance with an analysis result of data.

FIG. 16 illustrates an exemplary gate voltage modulating circuit within the gate driving circuit shown in FIG. 11. As shown in FIG. 16, an exemplary gate voltage modulating circuit includes a transistor Q1, and a first and second resistors R1 and R2. The transistor Q1 is turned on in response to a low logic voltage of the control signal for modulating the scanning pulse FLK, which is supplied to the base terminal, to form a current path between an emitter and a collector. In this case, the first and second resistors R1 and R1 act as a voltage division resistor. Accordingly, a voltage output via an output terminal OUT is changed to a gate modulating voltage Vgm between the gate high voltage Vgh and the gate low voltage Vgl. On the other hand, if the control signal for modulating the scanning pulse FLK is a high logic voltage, the transistor Q1 is turned off. In this case, the gate high voltage Vgh is output via the output terminal OUT.

The gate high voltage Vgh or the gate modulating voltage Vgm, which is output via the output terminal OUT, is supplied to a gate high voltage input terminal of a level shifter within the gate driving circuit. The level shifter converts a high logic voltage from the shift register into the gate high voltage Vgh or the gate modulating voltage Vgm to supply it to the gate lines G1 to Gn. Also, the level shifter converts a low logic voltage from the shift register into the gate low voltage Vgl to be supplied to the gate lines G1 to Gn.

Figure 17:
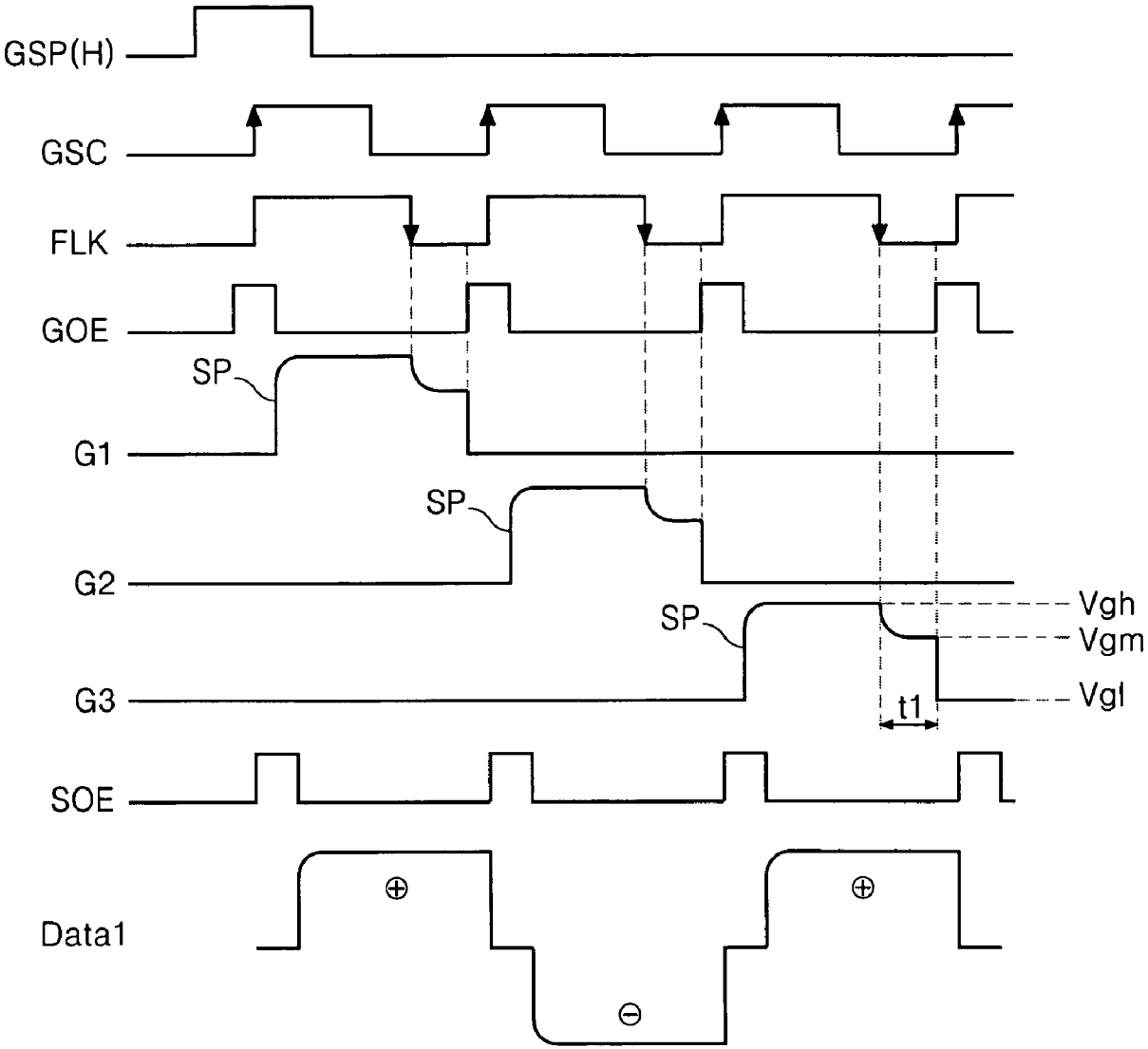
FIG. 17 is an exemplary waveform diagram illustrating a control signal for modulating a scanning pulse which is outputted from the FLK logic circuit in FIG. 11.

FIG. 17 is an exemplary waveform diagram illustrating gate timing control signals output from the timing controller 101 and the FLK logic circuit 107. As shown in FIG. 16, a rising edge of a control signal FLK for modulating a scanning pulse generated from the FLK logic circuit 107 is synchronized with a rising edge of the gate shift clock GSC and is wider than a pulse width of the gate shift clock GSC. The gate driving circuit 107 shifts the gate start pulse GSP and outputs the scanning pulse SP between pulses of the gate output enable signal GOE in response to the gate shift clock GSC. Furthermore, the gate driving circuit 107 is synchronized with a falling edge of the control signal FLK for modulating the scanning pulse to decrease the gate high voltage Vgh of the scanning pulse SP.

In the exemplary embodiment, the gate high voltage Vgh of the scanning pulse SP is about 20V, and the gate low voltage Vgl of the scanning pulse SP is about −5V. Further, a gate modulated voltage Vgm, which is decreased from the gate high voltage Vgh in accordance with the control signal FLK for modulating the scanning pulse in the scanning pulse SP, is about 15V. In the exemplary embodiment of the present invention, a modulation time t1 when the gate modulated voltage Vgm decreased from the gate high voltage Vgh is applied to the gate lines G1-G3 between the gate high voltage Vgh and the gate low voltage Vgl is about 4.5 μs to about 6.5 μs. This timing interval has been determined by optimizing the common voltage Vcom based on the center of the screen (B) or both side portions of the screen (A) and (C) and adjusting an applying time of the modulated voltage Vgm of the scanning pulse until shimmering noise effect does not occur across the entire screen. It has been found that if the modulation time t1 when the gate modulated voltage Vgm is applied is not more than 4.0 μs, the shimmering noise effect occurs at the center of the screen (B) or both side portions of the screen (A) and (C) due to non-uniformity of the charge amount of the liquid crystal cell in the center of the screen (B) and both side portions of the screen (A) and (C). In addition, it has been found that if the modulation time t1 when the gate modulated voltage Vgm is applied is not less than 7.0 μs, the shimmering noise effect occurs at the center of the screen (B) or both side portions of the screen (A) and (C) due to instability of the charge amount of the liquid crystal cell in the center of the screen (B) and both side portions of the screen (A) and (C).

The exemplary method of driving the liquid crystal display as described above may also be applied in conjunction with any first and second liquid crystal cell groups and driving method thereof as disclosed in, for example, co-pending Korean Patent Application Nos. P2007-004246 filed Jan. 15, 2007, P2007-052679 filed May 30, 2007, P2007-047787 filed May 16, 2007, and P2007-053959 filed Jun. 1, 2007.

As described above, the liquid crystal display and the driving method thereof according to the exemplary embodiments of the present invention control to lower the drive frequency of a data voltage supplied to the first liquid crystal cell group of the liquid crystal display panel to prevent DC image sticking and control to raise the drive frequency of a data voltage supplied to the second liquid crystal cell group of the liquid crystal display panel to prevent flicker, thereby improving the display quality. In addition, the liquid crystal display and the driving method thereof according to the exemplary embodiments of the present invention optimize the modulation time of the scanning pulse to compensate for non-uniformity and the instability of the charge amount of the liquid crystal cells at the center of the screen and both side portions of the screen, thereby preventing the shimmering noise effect.

Although the present invention has been explained by the embodiments shown in the drawings described above, it will be apparent to those skilled in the art that various modifications and variations can be made in the liquid crystal display and driving method thereof in accordance with the present invention without departing from the spirit or scope of the invention. Thus, it is intended that the present invention cover the modifications and variations of this invention provided they come within the scope of the appended claims and their equivalents.

What is claimed is:

1. A liquid crystal display, comprising:

a liquid crystal display panel including a plurality of data lines, a plurality of gate lines crossing the plurality of data lines, and a plurality of liquid crystal cells defined as first and second liquid crystal cell groups;

a data driving circuit to supply a data voltage to the data lines in response to a polarity control signal;

a gate driving circuit to supply a scanning pulse that swings between a gate high voltage and a gate low voltage to the gate lines;

a first logic circuit to generate the polarity control signal differently for each frame period to maintain a polarity of the data voltage charged in the first liquid crystal cell group for two frame periods, and to invert one time a polarity of the data voltage charged in the second liquid crystal cell group for two frame periods; and a second logic circuit configured to:

control the gate driving circuit to decrease the gate high voltage of the scanning pulse to a modulated voltage between the gate high voltage and the gate low voltage for a predetermined modulation time; and supply a control signal for modulating the scanning pulse to the gate driving circuit to control the modulation time, a falling edge of the control signal for modulating the scanning pulse being synchronized with the beginning of the predetermined modulation time, a rising edge of the control signal for modulating the scanning pulse being unsynchronized with the end of the predetermined modulation time, wherein the gate high voltage is about 20V, the gate low voltage is about −5V, and the modulated voltage is about 15V, and wherein the modulation time is more than 4.5 μs and equal or less than 5.5 μs.

2. The liquid crystal display according to claim 1, wherein the modulation time ranges from a start time of modulation between a rising edge of the scanning pulse and a falling edge of the scanning pulse to the falling edge of the scanning pulse.

3. The liquid crystal display according to claim 1, wherein:

the gate high voltage is supplied to the gate lines from the rising edge of the scanning pulse to a start time of modulation; and the modulated voltage is supplied to the gate lines for the modulation time, and then the gate low voltage is supplied to the gate lines for all other times.

4. The liquid crystal display according to claim 1, wherein the control signal is synchronized with a gate shift clock that shifts the scanning pulse.

5. The liquid crystal display according to claim 4, wherein:

a rising edge of the control signal for modulating the scanning pulse is synchronized with a rising edge of the gate shift clock; and a pulse width of the control signal for modulating the scanning pulse is wider than a pulse width of the gate shift clock.

6. A method of driving a liquid crystal display including a liquid crystal display panel that has a plurality of data lines, a plurality of gate lines crossing the plurality of data lines, and plurality of liquid crystal cells defined as first and second liquid crystal cell groups, the method comprising:

supplying a data voltage to the data lines in response to a polarity control signal;

supplying a scanning pulse, which is swung between a gate high voltage and a gate low voltage, to the gate lines;

generating the polarity control signal differently for each frame period to maintain a polarity of the data voltage in the first liquid crystal cell group for two frame periods, and to invert one time a polarity of the data voltage charged in the second liquid crystal cell group for two frame periods;

decreasing the gate high voltage of the scanning pulse to a modulated voltage between the gate high voltage and the gate low voltage for a predetermined modulation time;

controlling the modulation time by generating a control signal for modulating the scanning pulse;

supplying the control signal for modulating the scanning pulse to a gate driving circuit, a falling edge of the control signal for modulating the scanning pulse being synchronized with the beginning of the predetermined modulation time, a rising edge of the control signal for modulating the scanning pulse being unsynchronized with the end of the predetermined modulation time, wherein the gate high voltage is about 20V, the gate low voltage is about −5V, and the modulated voltage is about 15V, and wherein the modulation time is more than 4.5 μs and equal or less than 5.5 μs.

7. The method according to claim 6, wherein the modulation time ranges from a start time of modulation between a rising edge of the scanning pulse and a falling edge of the scanning pulse to the falling edge of the scanning pulse.

8. The method according to claim 6, wherein:

the gate high voltage is supplied to the gate lines from the rising edge of the scanning pulse to a start time of modulation; and the modulated voltage is supplied to the gate lines for the modulation time, and then the gate low voltage is supplied to the gate lines for all other times.

9. The method according to claim 6, wherein the control signal is synchronized with a gate shift clock that shifts the scanning pulse.

10. The method according to claim 9, wherein:

a rising edge of the control signal for modulating the scanning pulse is synchronized with a rising edge of the gate shift clock; and a pulse width of the control signal for modulating the scanning pulse is wider than a pulse width of the gate shift clock.

* * * * *